US009230788B2

(12) United States Patent
Okumura et al.

(10) Patent No.: US 9,230,788 B2
(45) Date of Patent: Jan. 5, 2016

(54) MASS SPECTROGRAPH APPARATUS AND METHOD OF DRIVING ION GUIDE

(75) Inventors: Daisuke Okumura, Mishima-gun (JP); Hiroto Itoi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/385,174

(22) PCT Filed: Mar. 16, 2012

(86) PCT No.: PCT/JP2012/056850

§ 371 (c)(1),
(2), (4) Date: Sep. 15, 2014

(87) PCT Pub. No.: WO2013/136509

PCT Pub. Date: Sep. 19, 2013

(65) Prior Publication Data

US 2015/0041642 A1 Feb. 12, 2015

(51) Int. Cl.

| | |
|---|---|
| ***H01J 49/26*** | (2006.01) |
| ***H01J 49/06*** | (2006.01) |
| ***H01J 49/36*** | (2006.01) |

(52) U.S. Cl.

CPC ..... *H01J 49/063* (2013.01); *H01J 49/36* (2013.01)

(58) Field of Classification Search

USPC ..... 250/281, 282, 283

See application file for complete search history.

(56) References Cited

U.S. PATENT DOCUMENTS

| | | | |
|---|---|---|---|
| 6,163,032 | A | 12/2000 | Rockwood |
| 7,049,580 | B2 | 5/2006 | Londry et al. |
| 8,124,930 | B2 | 2/2012 | Wang |
| 2003/0189171 | A1 | 10/2003 | Londry et al. |

(Continued)

FOREIGN PATENT DOCUMENTS

| | | | |
|---|---|---|---|
| AU | 2003213946 | A1 | 10/2003 |
| CA | 2 481 081 | A1 | 10/2003 |

(Continued)

OTHER PUBLICATIONS

International Search Report of PCT/JP2012/056850, dated Jun. 19, 2012. [PCT/ISA/210].

(Continued)

*Primary Examiner* — Nicole Ippolito
(74) *Attorney, Agent, or Firm* — Sughrue Mion, PLLC

(57) ABSTRACT

In eight electrodes arranged at an interval of a rotational angle of 45° around an ion optical axis, two neighboring electrodes are electrically connected together as one group, and electrodes in alternate groups are also electrically connected together. A voltage $V_{DC}$+v cos ωt is applied to electrodes in alternate groups around the optical axis, and a voltage $V_{DC}$−v cos ωt is applied to the other electrodes. Then, while an ion guide has the same electrode structure as that of an octupole-type ion guide, a radio-frequency electric field mainly having a quadrupole field component is formed, and the ion guide can be used as a quadrupole-type ion guide. Accordingly, only by changing the wiring for applying a voltage by using the electrodes having the same structure, ion guides of, for example, a quadrupole type and an octupole type, having different properties such as ion receiving properties and ion passing properties can be achieved.

7 Claims, 9 Drawing Sheets

(56) References Cited

U.S. PATENT DOCUMENTS

| | | | | |
|---|---|---|---|---|
| 2005/0178963 | A1 | 8/2005 | Londry et al. | |
| 2013/0175441 | A1 * | 7/2013 | Zanon et al. | 250/288 |
| 2014/0299761 | A1 * | 10/2014 | Giles | H01J 49/421 250/283 |

FOREIGN PATENT DOCUMENTS

| | | | |
|---|---|---|---|
| EP | 1 493 173 | A | 1/2005 |
| JP | S5311566 | A | 2/1978 |
| JP | 2005-522845 | A | 7/2005 |
| JP | 2010-118308 | A | 5/2010 |
| WO | 03/088305 | A1 | 10/2003 |

OTHER PUBLICATIONS

"Triple Quadrupole LC/MS/MS system LCMS-8030", [online], Shimadzu Corporation, [searched on Mar. 7, 2012], Internet.

Extended European Sear Report issued Apr. 28, 2015 in corresponding European Patent Application No. 12871185.0.

* cited by examiner

MASS SPECTROGRAPH APPARATUS AND METHOD OF DRIVING ION GUIDE

CROSS REFERENCE TO RELATED APPLICATIONS

This application is a National Stage of International Application No. PCT/JP2012/056850 filed Mar. 16, 2012, the contents of all of which are incorporated herein by reference in their entirety.

TECHNICAL FIELD

The present invention relates to a mass spectrometer including an ion guide that transports ions into a rear stage while converging the ions, and a driving method for operating the ion guide.

BACKGROUND ART

In mass spectrometers, in order to send ions sent from a front stage into a mass analyzer, such as a quadrupole mass filter, in a rear stage while converging the ions, an ion optical element called an ion guide is used. The ion guide typically has a multipole-type configuration in which four, six, eight, or more rod electrodes having an approximately cylindrical shape are arranged apart at an interval of the same angle around an ion optical axis, and parallel to each other. In the multipole-type ion guide as described above, normally, radio-frequency voltages having the same amplitude and the same frequency, and phases inverted from each other are respectively applied to two rod electrodes circumferentially adjacent around the ion optical axis. By applying the radio-frequency voltages as described above to the respective rod electrodes, a multipole radio-frequency electric field is formed in an approximately-cylindrical space surrounded by the rod electrodes, and ions are transported while being oscillated in the radio-frequency electric field.

To meet demands for enhanced sensitivity, enhanced accuracy or other improved qualities in the mass spectrometers, it is necessary to bring the shape of equipotential lines in the radio-frequency electric field in the ion guide closer to a theoretically-derived predetermined curve, thereby improving the qualities such as ion receiving properties and ion passing properties. To this end, the accuracy in the arrangement of the respective rod electrodes needs to be improved, and in order to achieve the improvement, the present applicant proposed an ion guide having a novel configuration in Patent Literature 1. One example of the ion guide is described with reference to FIG. 9 to FIG. 13.

FIG. 9A is a side view of an ion guide unit 100, and FIG. 9B and FIG. 9C are respectively sectional views on the lines A-A' and B-B' in FIG. 9A. The ion guide unit 100 includes an ion guide 110 in which eight metal plates extending in the direction of an ion optical axis C are employed as electrodes, and a hollow cylindrical case 140 that encloses the ion guide 110. The respective electrodes of the ion guide 110 are arranged rotationally symmetrical so as to be apart at an interval of an angle of 45° around the ion optical axis C, with their longitudinal-side end surfaces directed toward the ion optical axis C. Here, four electrodes alternately positioned among the eight electrodes are employed as first electrodes 111, and four electrodes adjacent thereto are employed as second electrodes 112.

FIG. 10 is a perspective view of one of the first electrodes 111. In the first electrode 111, an end edge on the side of the ion optical axis C has an arc shape or a hyperbolic shape bulging toward the ion optical axis C in a sectional plane perpendicular to the ion optical axis C. Further, the end edge on the side of the ion optical axis C is slightly inclined with respect to the ion optical axis C so as to become slightly apart from the ion optical axis C as an ion travels (rightward in FIG. 9C and FIG. 10). Because of the inclination, the intensity of the multipole electric field is smaller toward the outlet side of the ion guide 110, thereby decelerating flying ions. The other three plate electrodes of the first electrode 111, and the four electrode plates of the second electrodes 112 adjacent thereto also have the same shape.

The case 140 includes a tubular section 141 that encloses the first electrodes 111 and the second electrodes 112, a first support section 142 that is attached to one end portion of the tubular section 141 to support one end surfaces (left-side end surfaces in FIG. 9C) of the respective electrodes, a second support section 143 that is attached to the other end portion of the tubular section 141, and a disk spring fixing section 144 that fixes a disk spring 130 as shown in FIG. 11A by sandwiching the disk spring 130 between the disk spring fixing section 144 and the second support section 143. The first support section 142 and the second support section 143 are made of insulators such as ceramics, plastics or the like, and an opening for allowing ions to pass therethrough is provided in the center. A cylindrical through hole is provided in the second support section 143 at a position corresponding to each of the electrodes.

The disk spring 130 shown in FIG. 11A is made of metal, and includes a ring-shaped frame portion 131 and eight spring portions 132 working as cantilever springs projecting inward from the frame portion 131. The spring portions 132, each having a T shape with the head inward, are arranged so that the heads are close, but without contacting, to each other.

A thin plate 150 made of metal as shown in FIG. 11B is placed on a surface supporting the electrodes in the first support section 142. The thin plate 150 includes a ring-shaped frame portion 151 and four metal contacts 152 projecting inward from the frame portion 151. In the thin plate 150 placed on the first support section 142, the positions of the metal contacts 152 correspond to the positions of the first electrodes 111. Accordingly, the thin plate 150 contacts only the first electrodes 111, and does not contact the second electrodes 112.

FIG. 12 is a plan view of a state in which the disk spring 130 and the disk spring fixing section 144 are removed from the end portion on the side of the second support section 143 of the ion guide unit 100. Insulating spacers 121 made of insulators are inserted into four holes corresponding to the first electrodes 111, and conducting spacers 122 made of conductors are inserted into four holes corresponding to the second electrodes 112, as to the eight through holes provided in the second support section 143. The respective spacers are cylindrical members having the same length, which sets one end of the spacer to slightly project from the surface of the second support section 143 when the other end is in contact with the electrode.

FIG. 13 is a partial plan view of a state in which the disk spring 130 and the disk spring fixing section 144 are attached to the ion guide unit 100 shown in FIG. 12. The disk spring 130 is arranged such that the right and left ends close to each other of the adjacent spring portions 132 press the projecting portion of one insulating spacer 121 or one conducting spacer 122. Accordingly, the disk spring 130 is insulated from the first electrodes 111 by the insulating spacers 121, and electrically connected to the second electrodes 112 via the conducting spacers 122.

In the ion guide unit 100 having the above configuration, the spring portions 132 of the disk spring 130 press the first electrodes 111 and the second electrodes 112 toward the first support section 142 via the insulating spacers 121 or the conducting spacers 122. Accordingly, the respective electrodes 111 and 112 are sandwiched between the disk spring 130 and the first support section 142 from both sides and thereby fixed. At this point, end surfaces of the first electrodes 111 are in contact with the insulating spacers 121 or the metal thin plate 150, and end surfaces of the second electrodes 112 are in contact with the conducting spacers 122 or the second support section 143 made of an insulator. A voltage $V_{DC}+v\cdot\cos\omega t$ in which a radio-frequency voltage $v\cdot\cos\omega t$ is superimposed on a direct current voltage $V_{DC}$ is applied to the first electrodes 111 via the thin plate 150, and a voltage $V_{DC}-v\cdot\cos\omega t$ in which a radio-frequency voltage of inverted phase (i.e., phase shifted by 180°) is superimposed on the same direct current voltage is applied to the second electrodes 112 via the disk spring 130 and the conducting spacers 122 from a voltage application section (not shown in the drawing). Accordingly, a multipole radio-frequency electric field is formed in the space surrounded by the edge end surfaces of the eight electrodes 111 and 112, and ions introduced therein are converged.

Since the end edges of the eight electrodes 111 and 112 facing the ion optical axis C have an arc shape or a parabolic shape convex toward the ion optical axis C in a plane perpendicular to the ion optical axis C, an electric field whose equipotential lines are shaped along the curve is generated in the vicinity of the electrodes 111 and 112. Thus, an electric field nearly an ideal state can be formed in the space surrounded by the end surfaces of the respective electrodes 111 and 112.

Recent mass spectrometers tend to have a complicated configurations where, for example, a plurality of multipole-type ion guides as described above are used. In a liquid-chromatograph tandem quadrupole mass spectrometer described in Non Patent Literature 1, for example, a two-stage octupole-type ion guides are provided between an ion source and a first-stage quadrupole mass filter, and a quadrupole-type ion guide is disposed within a collision cell. That is, a plurality of ion guides having different number of poles are used in an apparatus. In conventional mass spectrometers, ion guides having different number of poles as described above have respective configurations different from each other. For example, when the above ion guide unit 100 is used, it is necessary to change not only the number of the metal plate electrodes, but also the shape of the members for holding the metal plate electrodes, such as the first support section 142, the second support section 143 and the disk spring 130, according to the number of poles. If, in the mass spectrometer using a plurality of ion guides as described above, ion guides having the same structure can be used, it is advantageous in reducing the cost.

CITATION LIST

Patent Literature

[Patent Literature 1] JP 2010-118308 A

Non Patent Literature

[Non Patent Literature 1] "Triple Quadrupole LC/MS/MS system LCMS-8030", [online], Shimadzu Corporation, [searched on Mar. 7, 2012], Internet

SUMMARY OF INVENTION

Technical Problem

The present invention has been made in view of the above problem, and an object thereof is to provide a mass spectrometer including a plurality of ion guides with a different number of poles, the mass spectrometer capable of using ion guides having the same mechanical configuration and structure as the plurality of ion guides regardless of the difference in the number of poles. Also, another object of the present invention is to provide a method of driving ion guides having the same mechanical configuration and structure as if they were ion guides having different number of poles, such as a quadrupole and an octupole.

Solution to Problem

A mass spectrometer according to the present invention, which has been made in order to achieve the above object, is a mass spectrometer including an ion guide in which 2n (n is an integer) rod-like or plate-like electrodes extending along an ion optical axis are arranged so as to surround the ion optical axis, the mass spectrometer further including:

a) voltage generating means for generating a first radio-frequency voltage and a second radio-frequency voltage having a same amplitude as and an inverted phase from the first radio-frequency voltage, as voltages for forming a radio-frequency electric field in a space surrounded by the respective electrodes of the ion guide; and b) electrical connecting means for electrically connecting the voltage generating means and the respective electrodes of the ion guide so that the first radio-frequency voltage is applied to m (m is an integer equal to or larger than 2 and equal to or less than 2n−1) electrodes adjacent to each other around the ion optical axis among the 2n electrodes constituting the ion guide, and the second radio-frequency voltage is applied to at least one of the other 2n−m electrodes.

A method of driving an ion guide according to the present invention, which has been made in order to achieve the above object, is a method of driving an ion guide where in an ion guide in which 2n (n is an integer equal to or larger than 3) rod-like or plate-like electrodes extending along an ion optical axis are arranged so as to surround the ion optical axis, predetermined voltages are applied to the respective electrodes to form an electric field for controlling a behavior of ions in a space surrounded by the electrodes, the method including:

applying a first radio-frequency voltage to m (m is an integer equal to or larger than 2 and equal to or less than 2n−1) electrodes adjacent to each other around the ion optical axis among the 2n electrodes constituting the ion guide, and applying a second radio-frequency voltage having a same amplitude as and an inverted phase from the first radio-frequency voltage to at least one of the other 2n−m electrodes.

In a method of driving an ion guide in a conventional mass spectrometer as described above, the first radio-frequency voltage is applied to one of any two neighboring electrodes among the 2n electrodes constituting the ion guide around the ion optical axis, and the second radio-frequency voltage is applied to the other of the two neighboring electrodes so as to transport ions while converging the ions. In other words, the same radio-frequency voltage is applied to alternate electrodes around the ion optical axis. Therefore, a radio-frequency electric field predominantly composed of a 2n multipole field component is formed in the space surrounded by the electrodes (where the theoretical 2n multipole field component alone should develop, but actually other multipole field components are involved). In this case, the shape of the radio-frequency electric field (the shape of equipotential lines by the radio-frequency electric field) is rotationally symmetrical about the ion optical axis within a plane perpendicular to the ion optical axis. On the other hand, in the mass spectrometer and the ion guide driving method according to the present invention, the first radio-frequency voltage is applied to two or more neighboring electrodes in at least one portion around the ion optical axis. Therefore, the main component of the radio-frequency electric field formed in the space surrounded by the 2n electrodes constituting the ion guide is not the 2n multipole field component.

To be more specific, in a first aspect of the mass spectrometer according to the present invention, the number of electrodes constituting the ion guide may be $n=p\times q$ (where p is an integer equal to or larger than 2, and q is an integer equal to or larger than 4), and the electrical connecting means may be adapted to electrically connect the voltage generating means and the respective electrodes of the ion guide such that, among q electrode groups, where an electrode group consists of any p electrodes adjacent to each other around the ion optical axis, the first radio-frequency voltage is applied to $p\times q/2$ electrodes belonging to q/2 electrode groups positioned alternately around the ion optical axis, and the second radio-frequency voltage is applied to the other $p\times q/2$ electrodes belonging to other q/2 electrode groups.

In a typical configuration of the first aspect, n may be 8, p may be 2, q may be 4, and a radio-frequency electric field mainly having a quadrupole field component may be formed in the space surrounded by the eight electrodes constituting the ion guide. In this case, the arrangement itself of the electrodes to which the first radio-frequency voltage is applied, and the electrodes to which the second radio-frequency voltage is applied around the ion optical axis is rotationally symmetrical. Therefore, the shape of the radio-frequency electric field is rotationally symmetrical about the ion optical axis within a plane perpendicular to the ion optical axis. Thus, ions introduced into the ion guide travel along the ion optical axis as a whole while being oscillated around the ion optical axis by the effect of the radio-frequency electric field.

According to the conventional ion guide driving method as described above, a radio-frequency electric field mainly having an octupole field component is formed in the space surrounded by the eight electrodes constituting the ion guide. On the other hand, in the present aspect, while the number of the electrodes is the same 8, a radio-frequency electric field substantially equal to that of a quadrupole-type ion guide is formed. That is, only by changing the electrical connecting means without changing the electrode configuration itself of the ion guide at all, the ion guide can be used as a normal octupole-type ion guide, and can also be used as a quadrupole-type ion guide.

In a second aspect of the mass spectrometer according to the present invention, the electrical connecting means may be adapted to electrically connect the voltage generating means and the respective electrodes of the ion guide such that arrangement of the electrodes to which the first radio-frequency voltage is applied and the electrodes to which the second radio-frequency voltage is applied around the ion optical axis is rotationally asymmetrical. In the configuration, for example, the same radio-frequency voltage is applied to three or more adjacent electrodes only in a certain portion around the ion optical axis.

Unlike in the above first aspect, in the case of the second aspect, the shape of the radio-frequency electric field formed in the space surrounded by the 2n electrodes is rotationally asymmetrical about the ion optical axis within a plane perpendicular to the ion optical axis. Therefore, ions introduced into the ion guide receive a force in a biased direction within the plane perpendicular to the ion optical axis at the time of introduction. The ions thereby travel while gradually deviating from the center axis of the 2n electrodes linearly extended from the ion optical axis at the time of introduction, that is, while being deflected. That is, the ion guide according to the second aspect is used as an ion guide in which ions introduced along a certain ion optical axis are sent along an ion optical axis that is not on the same straight line as nor parallel to the ion optical axis.

In the mass spectrometer according to the present invention, the electrical connecting means is a wiring section in a broad sense for connecting the voltage generating means and the respective electrodes, including various cable lines, patterned lines on a substrate, connectors and various conductive members for connection.

Advantageous Effects of Invention

Owing to the mass spectrometer and the ion guide driving method according to the present invention, in a case in which the ion guides having different number of poles, such as a quadrupole-type ion guide and an octupole-type ion guide, are used in an apparatus, any radio-frequency electric field having a property according to the number of poles, such as a quadrupole and an octupole, can be formed by using ion guides having the same number of electrodes and the same electrode arrangement. Accordingly, it is not necessary to prepare ion guides having different configuration or structure for each ion guide having different number of poles, which allows using common parts or members and reducing the number of parts and members thereby reduces the product costs. Consequently, the apparatus can be provided at lower cost than before.

Also, owing to the mass spectrometer and the ion guide driving method according to the present invention, not only a high-order multipole electric field, but also a deflection electric field can be formed. For example, an off-axis ion optical system that excludes neutral particles to be recognized as noise in a mass analysis can be thereby easily constructed.

Moreover, not only a simple high-order multipole electric field, but also a radio-frequency electric field in which a plurality of high-order multipole electric fields are intentionally superimposed can be formed. This allows a fine tuning of the properties, such as the ion receiving properties and ion passing properties, according to purposes or the like.

DESCRIPTION OF EMBODIMENTS

In the following, a mass spectrometer which is one embodiment of the present invention is described with reference to the accompanying drawings.

Figure 1:
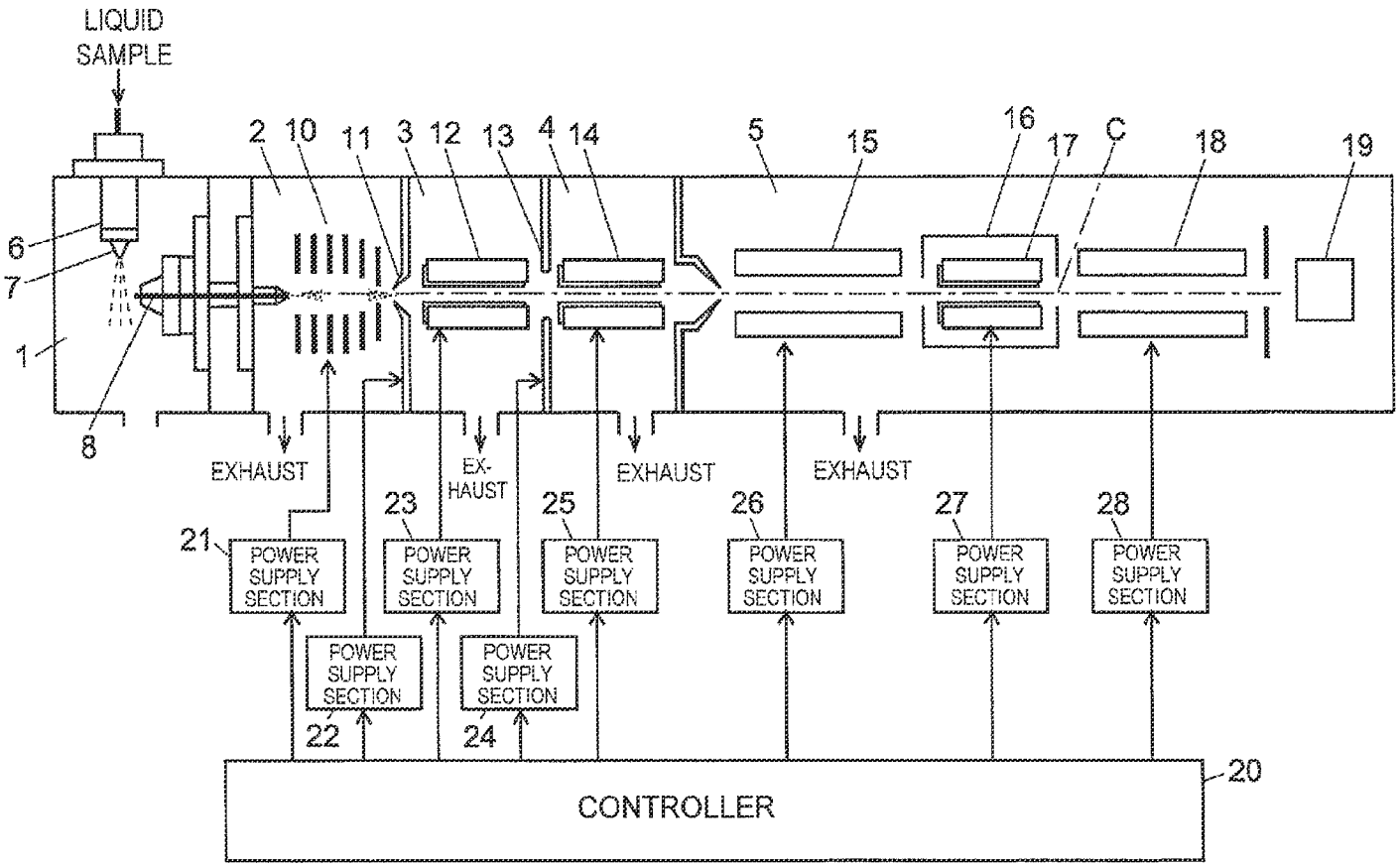
FIG. 1 is an overall configuration diagram of a mass spectrometer according to one embodiment of the present invention.

FIG. 1 is an overall configuration diagram of a mass spectrometer according to a first embodiment. The mass spectrometer is a tandem quadrupole mass spectrometer capable of executing an MS/MS analysis on components in a liquid sample supplied from a liquid chromatograph (LC) or the like.

The mass spectrometer of the present embodiment includes an ionization chamber 1 which is maintained at an approximately atmospheric pressure, an analysis chamber 5 that is maintained under a high vacuum atmosphere by vacuum evacuation using a vacuum pump such as a turbomolecular pump (not shown), and a first intermediate vacuum chamber 2, a second intermediate vacuum chamber 3, and a third intermediate vacuum chamber 4 that are respectively maintained under intermediate gas pressures between a gas pressure in the ionization chamber 1 and a gas pressure in the analysis chamber 5 by vacuum evacuation using a vacuum pump. That is, in the mass spectrometer, the configuration of a multiple-stage differential evacuation system is employed in which the gas pressure becomes lower (the degree of vacuum becomes higher) through the respective chambers from the ionization chamber 1 toward the analysis chamber 5.

In the ionization chamber 1, an ionization probe 6 that is connected to an outlet end of aLC column (not shown) is disposed. In the analysis chamber 5, a front-stage quadrupole mass filter 15, a collision cell 16 in which a fourth ion guide 17 is arranged, a rear-stage quadrupole mass filter 18, and an ion detector 19 are disposed. Also, in the first to third intermediate vacuum chambers 2, 3, and 4, first to third ion guides 10, 12, and 14 are disposed so as to transport ions into a rear stage. The ionization chamber 1 and the first intermediate vacuum chamber 2 communicate with each other via a small-diameter desolventizing tube 8. Also, the first intermediate vacuum chamber 2 and the second intermediate vacuum chamber 3 communicate with each other through a micro-diameter opening formed in a top portion of a skimmer 11, and the second intermediate vacuum chamber 3 and the third intermediate vacuum chamber 4 communicate with each other through a circular opening of an ion lens 13 provided in a partition wall.

A high voltage of about several kV is applied to a tip of a nozzle 7 of the ionization probe 6 from a direct current high-voltage power supply (not shown). When a liquid sample introduced into the ionization probe 6 reaches the tip of the nozzle 7, the liquid sample is given a biased electric charge, and sprayed into the ionization chamber 1. Tiny droplets in a mist flow are micronized upon contacting an atmospheric gas, and further micronized with a mobile phase or a solvent volatilized. During the process, sample components included in the droplets break out of the droplets with electric charges, and become gaseous ions. The generated ions are sucked into the desolventizing tube 8 due to a differential pressure between the ionization chamber 1 and the first intermediate vacuum chamber 2, and sent into the first intermediate vacuum chamber 2.

An ion transport optical system from the first ion guide 10 to the third ion guide 14 has a function to transport the ions to the front-stage quadrupole mass filter 15 in the analysis chamber 5 with lowest loss of ions as possible. Power supply sections 21 to 25 respectively apply a voltage in which a direct current voltage and a radio-frequency voltage are superimposed on each other, or a direct current voltage alone to the respective ion guides 10, 12, and 14, the skimmer 11, and the ion lens 13 under the control of a controller 20.

The ions are sent into the front-stage quadrupole mass filter 15 by the above ion transport optical system. A voltage in which a direct current voltage and a radio-frequency voltage are superimposed on each other corresponding to a mass-to-charge ratio of an ion as an analysis target is applied to a rod electrode constituting the front-stage quadrupole mass filter 15 from a power supply section 26, and only ions having the mass-to-charge ratio corresponding to the voltage pass through a space in a long-axis direction of the filter 15 to be introduced into the collision cell 16. A predetermined CID gas, such as Ar, is supplied into the collision cell 16 from a gas supply source (not shown), and the ions (precursor ions) collide with the CID gas and are thereby dissociated. Product ions generated by the dissociation are sent to the rear-stage quadrupole mass filter 18 while being converged by the fourth ion guide 17.

A voltage in which a direct current voltage and a radio-frequency voltage are superimposed on each other corresponding to a mass-to-charge ratio of a product ion as an analysis target is applied to a rod electrode constituting the rear-stage quadrupole mass filter 18 from a power supply section 28, and only ions having the mass-to-charge ratio corresponding to the voltage pass through a space in a long-axis direction of the filter 18, and reach the ion detector 19. The ion detector 19 outputs a detection signal corresponding to the amount of the reaching ions, and a data processing section (not shown) creates, for example, an MS/MS spectrum based on the detection signal.

In the above configuration, all of the second ion guide 12, the third ion guide 14, and the fourth ion guide 17 in the collision cell 16 have a function to transport ions into a rear stage while converging the ions. For example, in a conventional mass spectrometer described in Non Patent Literature 1, octupole-type ion guides are used as the second ion guide 12 and the third ion guide 14, and a quadrupole-type ion guide is used as the fourth ion guide 17, while in the mass spectrometer of the present embodiment, ion guides having the same electrode configuration are used as the three ion guides 12, 14, and 17.

Figure 2A:
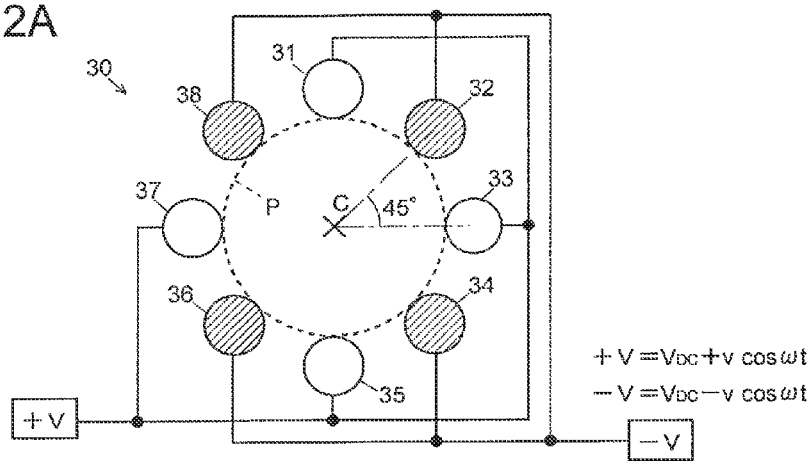
FIG. 2A is a view illustrating an application state of a radio-frequency voltage in an ion guide according to a first embodiment.
Figure 2B:
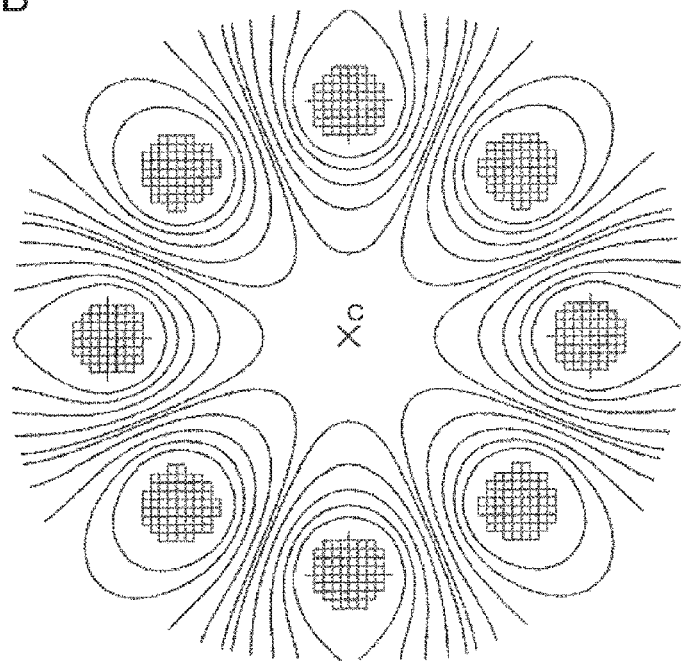
FIG. 2B is a view illustrating a potential distribution by a simulation calculation at this time.
Figure 3A:
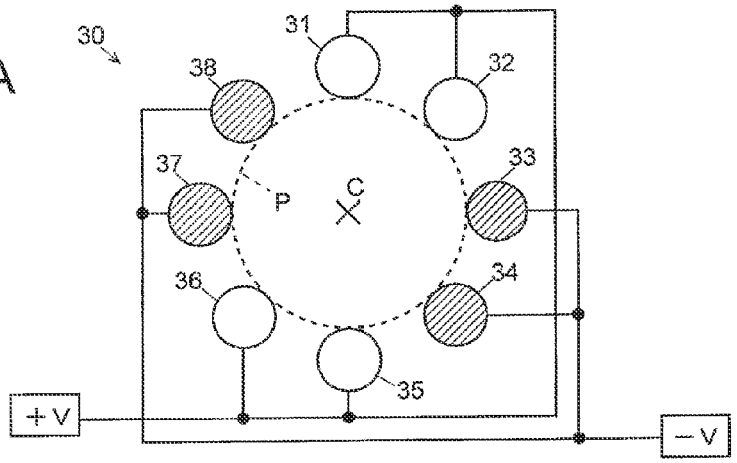
FIG. 3A is a view illustrating another application state of a radio-frequency voltage in the ion guide according to the first embodiment.
Figure 3B:
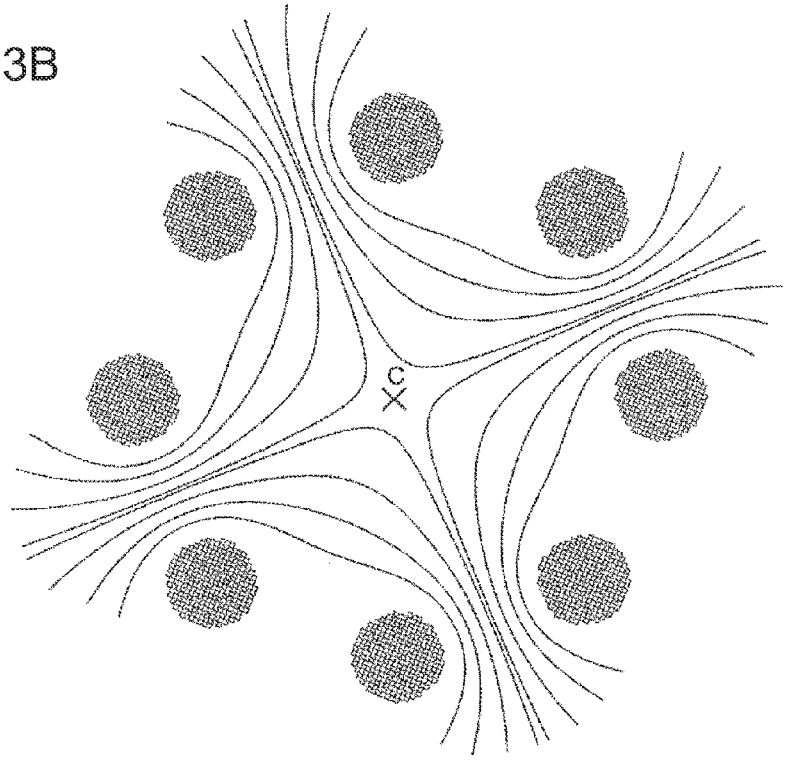
FIG. 3B is a view illustrating a potential distribution by a simulation calculation at this time.

In the following, the above ion guide used in the present embodiment is described in detail. FIG. 2A is a view illustrating an application state of a radio-frequency voltage in the second and third ion guides 12 and 14, and FIG. 3A is a view illustrating an application state of a radio-frequency voltage in the fourth ion guide 17. Also, FIG. 2B is a view illustrating a potential distribution by a simulation calculation at the time of FIG. 2A, and FIG. 3B is a view illustrating a potential distribution by a simulation calculation at the time of FIG. 3A.

Each of the ion guides 12, 14, and 17 includes eight approximately cylindrical rod electrodes 31 to 38 that are arranged apart at an interval of a rotation angle of 45° around a linear ion optical axis C, and parallel to each other. The rod electrodes 31 to 38 are inscribed on a cylinder P whose center axis is aligned with the ion optical axis C, and the arrangement of the rod electrodes 31 to 38 is rotationally symmetrical about the ion optical axis C. FIG. 2A and FIG. 3A are sectional views of the ion guide taken along a plane perpendicular to the ion optical axis C.

As described above, while the ion guides 12, 14, and 17 have the same electrode shape and arrangement, voltages are applied to the respective rod electrodes 31 to 38 in different manners. That is, as shown in FIG. 2A, in the second and third ion guides 12 and 14, alternate rod electrodes around the ion optical axis C are electrically connected to each other. That is, the rod electrodes 31, 33, 35, and 37 are electrically connected to each other, and the remaining rod electrodes 32, 34, 36, and 38 are electrically connected to each other. A voltage $V_{DC}$+v cos ωt in which a radio-frequency voltage v cos ωt is superimposed on a direct current voltage $V_{DC}$ is applied to the former four rod electrodes 31, 33, 35, and 37 from the power supply section 23 (or 25), and a voltage $V_{DC}$−v cos ωt in which a radio-frequency voltage −v cos ωt of inverted phase is superimposed on the same direct current voltage $V_{DC}$ is applied to the latter four rod electrodes 32, 34, 36, and 38 from the power supply section 23 (or 25). That is, a wiring section, as shown in FIG. 2A, that connects the respective rod electrodes 31 to 38 and the power supply section 23 (or 25) corresponds to electrical connecting means in the present invention. In FIG. 2A and FIG. 3A, the sections of the rod electrodes to which the voltage $V_{DC}$−v cos ωt is applied are indicated by diagonal lines.

The same voltage $V_{DC}$+v cos ωt is applied to the alternate four rod electrodes 31, 33, 35, and 37 around the ion optical axis C, and the same voltage $V_{DC}$−v cos ωt is applied to the four rod electrodes 32, 34, 36, and 38 respectively adjacent to these rod electrodes around the ion optical axis C. This is the same as a general octupole-type ion guide, and a radio-frequency electric field mainly having an octupole field component is formed in a space surrounded by the rod electrodes 31 to 38 by the voltages applied to the respective rod electrodes 31 to 38 as described above. The shape of equipotential lines by the radio-frequency electric field is a rotationally-symmetrical shape centering on the ion optical axis C as shown in FIG. 2B.

On the other hand, as shown in FIG. 3A, in the fourth ion guide 17, two rod electrodes adjacent to each other around the ion optical axis C are electrically connected to each other as one group, and rod electrodes included in alternate groups around the ion optical axis C are also electrically connected to each other. That is, the four rod electrodes 31, 32, 35, and 36 are electrically connected to each other, and the remaining four rod electrodes 33, 34, 37, and 38 are electrically connected to each other. A voltage $V_{DC}$+v cos ωt in which a radio-frequency voltage v cos ωt is superimposed on a direct current voltage $V_{DC}$ to each other is applied to the former four rod electrodes 31, 32, 35, and 36 from the power supply section 23 (or 25), and a voltage $V_{DC}$−v cos ωt in which a radio-frequency voltage −v cos ωt of inverted phase is superimposed on the same direct current voltage $V_{DC}$ to each other is applied to the latter four rod electrodes 33, 34, 37, and 38 from the power supply section 23 (or 25). That is, in this case, a wiring section, as shown in FIG. 3A, that connects the respective rod electrodes 31 to 38 and the power supply section 23 (or 25) also corresponds to the electrical connecting means in the present invention.

In this case, since the two neighboring rod electrodes belonging to the same group have the same potential, the two rod electrodes can be considered as one electrode in view of the potential. This is a pseudo quadrupole-type ion guide, and a radio-frequency electric field mainly having a quadrupole field component is formed in a space surrounded by the rod electrodes 31 to 38 by the voltages applied to the respective rod electrodes 31 to 38 as described above. The shape of equipotential lines by the radio-frequency electric field is also a rotationally-symmetrical shape centering on the ion optical axis C as shown in FIG. 3B.

Figure 4A:
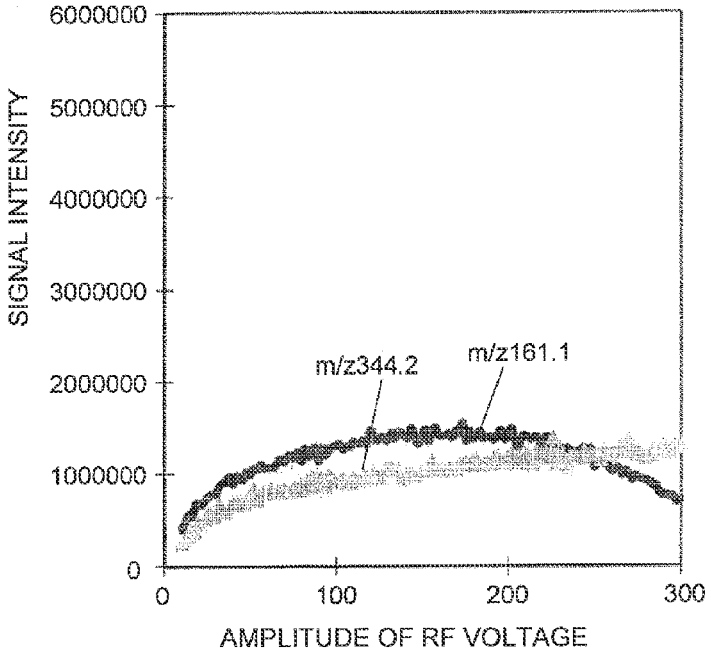
FIG. 4A and FIG. 4B are views illustrating the results of measuring a relationship between the amplitude of the radio-frequency voltage and the signal intensity in the states shown in FIG. 2A and FIG. 2B, and FIG. 3A and FIG. 3B.
Figure 4B:
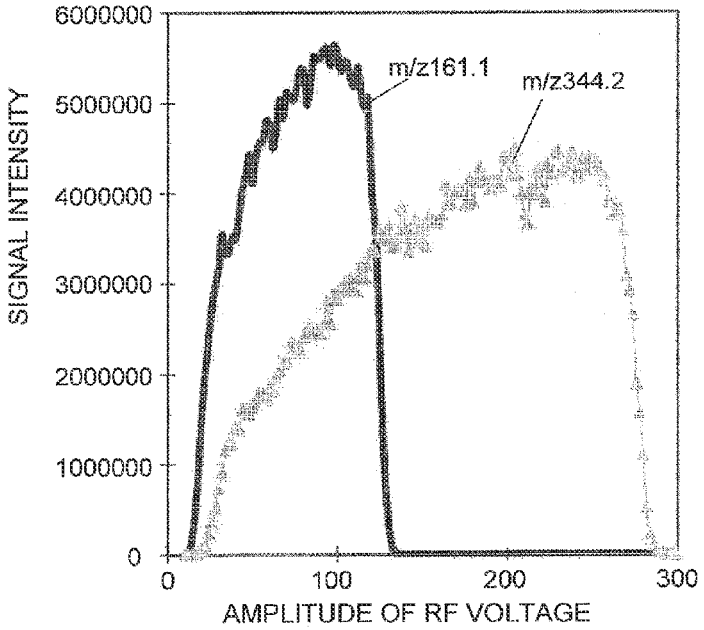

FIG. 4A is a view illustrating the result of measuring a relationship between the amplitude of the radio-frequency voltage and the signal intensity in a drive state as the octupole-type ion guide shown in FIG. 2A and FIG. 2B, and FIG. 4B is a view illustrating the result of measuring a relationship between the amplitude of the radio-frequency voltage and the signal intensity in a drive state as the pseudo quadrupole-type ion guide shown in FIG. 3A and FIG. 3B. By reference to FIG. 4B, it is found that the signal intensity is remarkably reduced when the amplitude of the radio-frequency voltage becomes larger. This is considered to be because the quadrupole field component has a more remarkable Low Mass Cut-off phenomenon, and then ions are diverged. On the other hand, in view only of the magnitude of the signal intensity, the signal intensity is remarkably higher in FIG. 4B than in FIG. 4A. This is considered to be because the quadrupole field component has a stronger ion convergence effect. Accordingly, it is found that a higher sensitivity can be achieved with the ion guide shown in FIG. 3A and FIG. 3B.

Based on the above results, it is found that even when the rod electrodes have the configuration (shape, arrangement or the like) of the octupole-type ion guide, the ion guide can be substantially operated as the quadrupole-type ion guide only by changing the wiring section for applying a radio-frequency voltage, in other words, only by changing a method of driving the ion guide. As described above, in the mass spectrometer of the present embodiment, the electrodes having the same configuration as those of the second and third ion guides 12 and 14 can be used as the fourth ion guide 17 arranged in the collision cell 16, thereby reducing the cost of the apparatus.

Figure 5A:
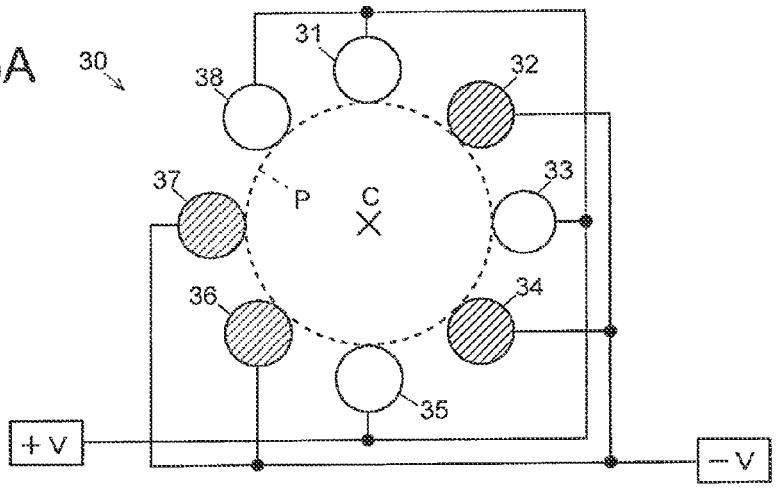
FIG. 5A is a view illustrating yet another application state of a radio-frequency voltage in the ion guide according to the first embodiment.
Figure 5B:
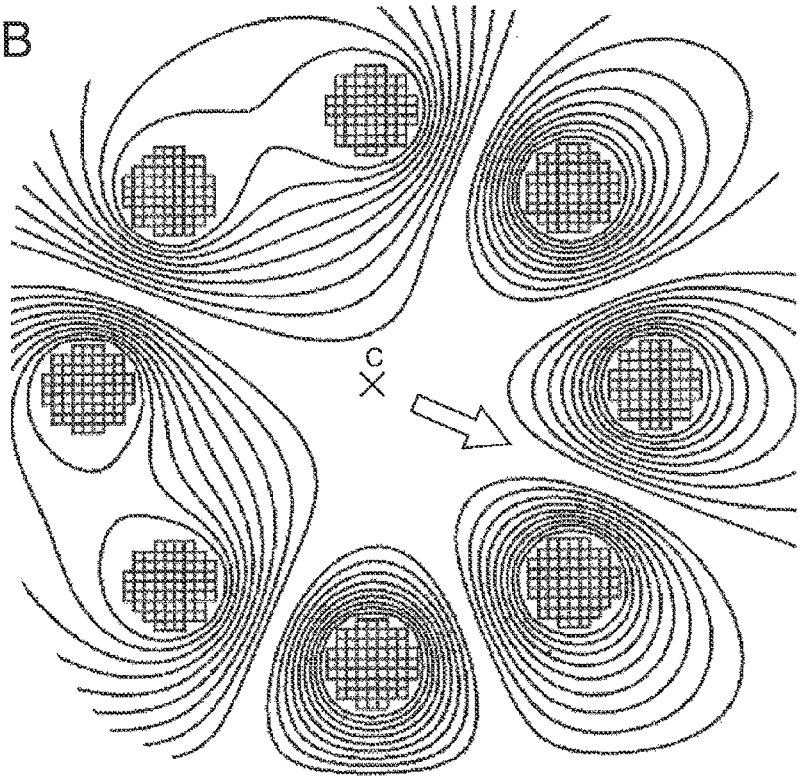
FIG. 5B is a view illustrating a potential distribution by a simulation calculation at this time.

Although the shape of the radio-frequency electric field formed by the rod electrodes 31 to 38 is the rotationally-symmetrical shape centering on the ion optical axis C in the above embodiment, a deflection electric field for deflecting ions can be also formed in the space surrounded by the rod electrodes 31 to 38 by changing the applied voltages so as to obtain a rotationally-asymmetrical shape. FIG. 5A is a view illustrating one example of an application state of a radio-frequency voltage when a deflection electric field is formed in the electrode configuration shown in FIG. 2A and FIG. 3A, and FIG. 5B is a view illustrating a potential distribution by a simulation calculation at the time of FIG. 5A.

As shown in FIG. 5A, in the example, the voltage $V_{DC}$+v cos ωt is applied to the four rod electrodes 31, 33, 35, and 38 from the power supply section 23 (or 25), and the voltage $V_{DC}$−v cos ωt is applied to the remaining four rod electrodes 32, 34, 36, and 37 from the power supply section 23 (or 25). Accordingly, in the space surrounded by the rod electrodes 31 to 38, a radio-frequency electric field having an equipotential line shape that is not rotationally symmetrical is formed around the ion optical axis C as shown in FIG. 5B. By the effect of the rotationally-asymmetrical radio-frequency electric field, ions receive a force in a direction indicated by an arrow in FIG. 5B. Therefore, the path of ions introduced into the ion guide along the ion optical axis C gradually deviates and is deflected in the direction of the arrow in FIG. 5B as the ions travel. Consequently, the ions exit from the ion guide along a center trajectory inclined at a predetermined angle with respect to the ion optical axis C (in this case, since the ion optical axis C is not in the center of the ion trajectory, the ion optical axis C is not an ion optical axis in the strict sense) in FIG. 5A and FIG. 5B.

Normally, in the mass spectrometer, a so-called off-axis (or axis-deviating) ion optical system is sometimes used so as to remove neutral particles (e.g., sample component molecules that are not ionized) originating from the sample components and mixed in an ion stream. For this purpose, for example, in Japanese Patent No. 3542918 and U.S. Patent Application Publication No. 2009/0294663, an ion guide using a rod electrode having a curved shape is proposed. However, it is difficult to accurately manufacture the electrode having such a shape. On the other hand, in the above example, the ion guide in which an ion injection axis and an ion exit axis diagonally cross each other can be obtained only by changing the ion guide driving method in the normal electrode structure, which is very advantageous in view of costs.

Also, in the above embodiment, the radio-frequency electric field having a multipole field component different from the number of the electrodes, or the deflection electric field is formed by changing the electrical connection between the respective rod electrodes of the ion guide and the power supply section. As a specific method for changing the electrical connection, various methods, for example, of connecting a cable line as the wiring section to a different portion, changing the pattern wiring of a substrate, or using a relay cable for switching wires may be employed. Also, when an ion guide unit 100 described using FIG. 9 to FIG. 13 is used as the ion guide, the electrical connection can be easily changed by using exactly the same parts without changing various parts constituting the ion guide unit 100 at all.

Figure 9A:
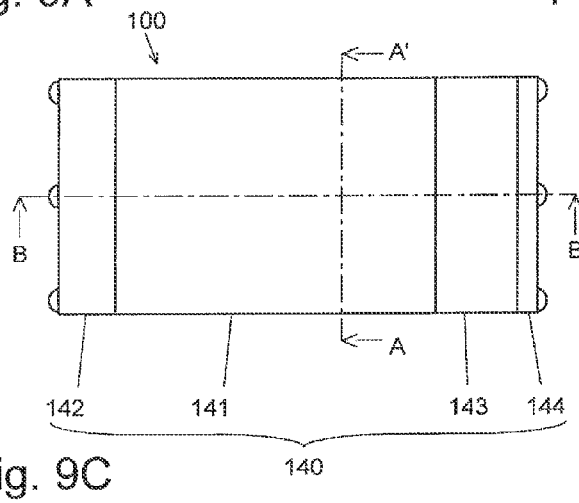
FIG. 9A is a side view of a conventional ion guide unit.
Figure 9B:
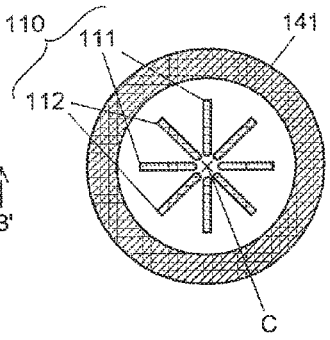
FIG. 9B is a sectional view on a line A-A' and FIG. 9C is a sectional view on a line B-B' in FIG. 9A.
Figure 9C:
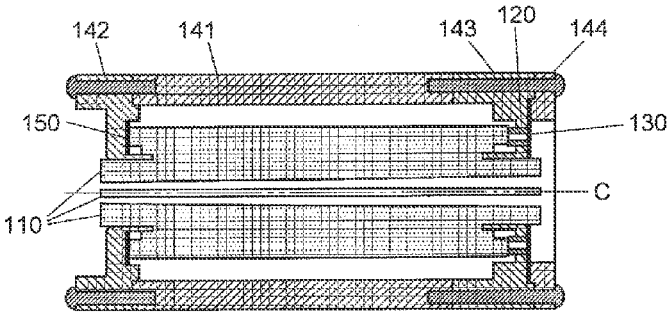
Figure 10:
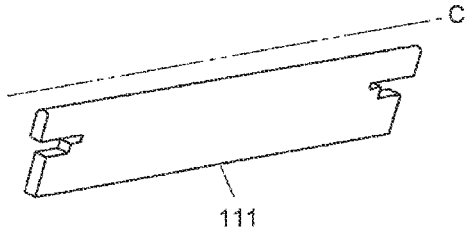
FIG. 10 is a perspective view of an electrode in FIG. 9A, FIG. 9B, and FIG. 9C.
Figure 11A:
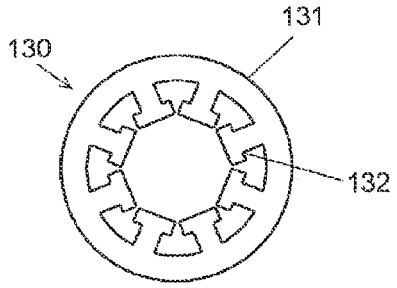
FIG. 11A is a plan view of a disk spring and FIG. 11B is a plan view of a thin plate in FIG. 9A, FIG. 9B, and FIG. 9C.
Figure 11B:
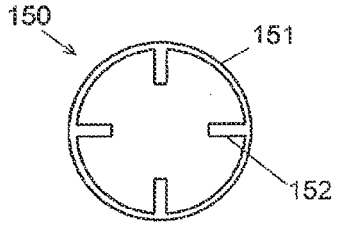
Figure 12:
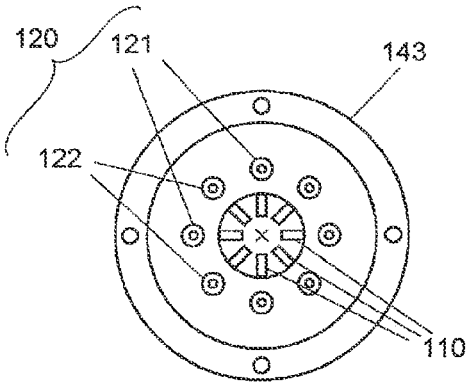
FIG. 12 is a plan view of the ion guide unit before the disk spring and a disk spring fixing section are attached thereto.
Figure 13:
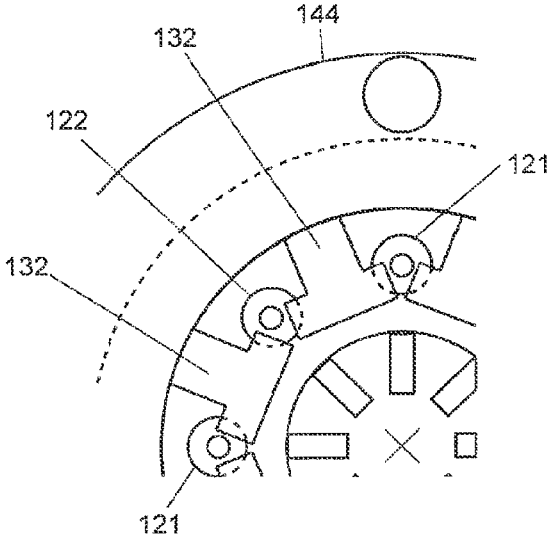
FIG. 13 is an enlarged plan view of the ion guide unit after the disk spring and the disk spring fixing section are attached thereto.

To be more specific, in a configuration in which an ion guide 101 includes eight electrodes as shown in FIG. 9A, FIG. 9B, and FIG. 9C, when the ion guide 101 is operated as the octupole-type ion guide, conducting spacers 122 and insulating spacers 121 are alternately arranged around an ion optical axis C as shown in FIG. 12. On the other hand, when the ion guide 101 is operated as the quadrupole-type ion guide, the insertion positions of the conducting spacers 122 and the insulating spacers 121 into eight through holes provided in a second support section 143 may be changed such that two conducting spacers 122 are arranged adjacent to each other around the ion optical axis C, and two insulating spacers are arranged next thereto so as to be adjacent to each other.

As described above, in the ion guide unit 100, any one of the octupole-type ion guide and the pseudo quadrupole-type ion guide as shown in FIG. 3A and FIG. 3B can be configured only by changing the insertion positions of the conducting spacers 122 and the insulating spacers 121 at the time of assembling, without changing the configuration itself of a metal thin plate 150, the second support section 143, the conducting spacers 122, the insulating spacers 121 or the like, which correspond to the electrical connecting means in the present invention.

Figure 6A:
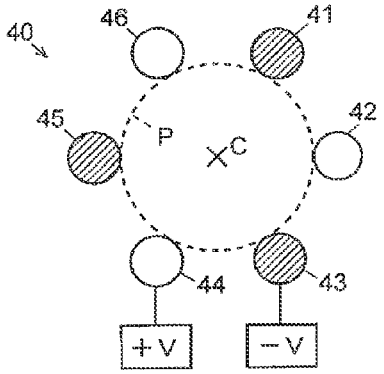
FIG. 6A and FIG. 6B are views illustrating an example of an application state of a radio-frequency voltage in an ion guide according to a second embodiment.
Figure 6B:
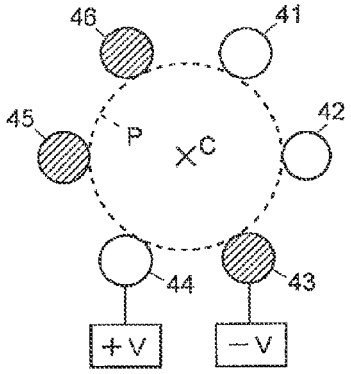
Figure 7A:
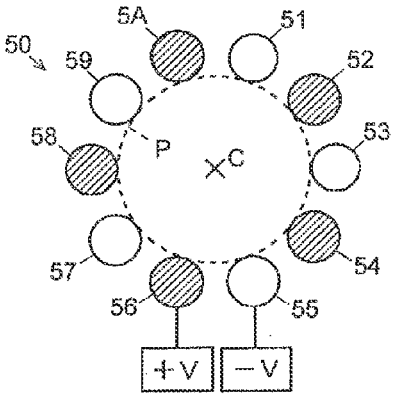
FIG. 7A and FIG. 7B are views illustrating an example of an application state of a radio-frequency voltage in an ion guide according to a third embodiment.
Figure 7B:
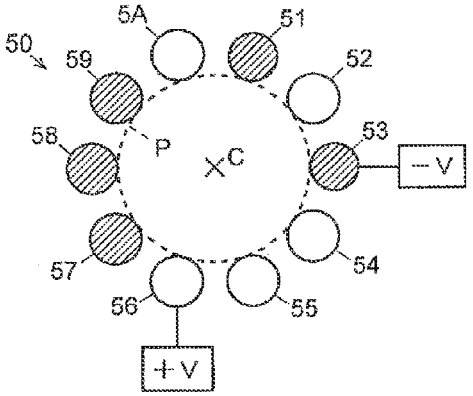
Figure 8A:
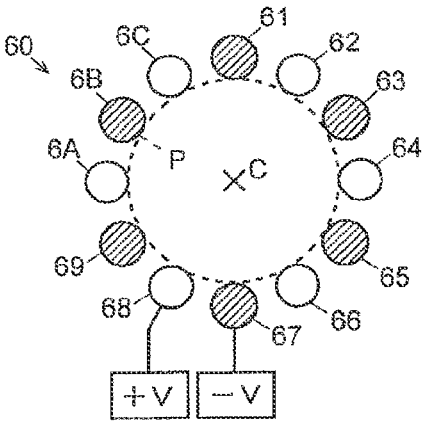
FIG. 8A and FIG. 8B are views illustrating an example of an application state of a radio-frequency voltage in an ion guide according to a fourth embodiment.
Figure 8B:
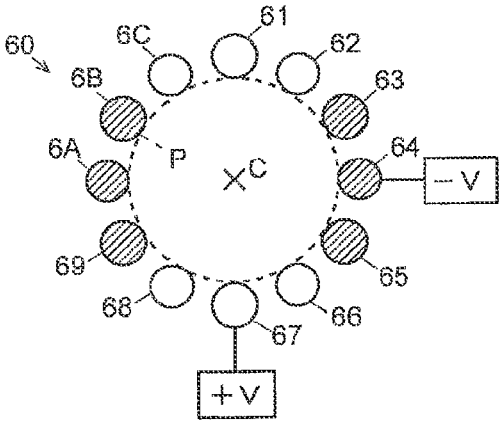

Also, while the above embodiments are examples in which the number of the electrodes is 8, the number of the electrodes may be 2n (n is an integer equal to or larger than 3). FIG. 6A to FIG. 8C are views respectively illustrating application states of radio-frequency voltages to respective electrodes constituting ion guides 40, 50, and 60 when n is 3, 5, and 6. All of FIG. 6A, FIG. 7A, and FIG. 8A show voltage application states when the respective ion guides 40, 50, and 60 are operated as hexapole-type, decapole-type, and dodecapole-type ion guides according to the respective numbers of the electrodes. On the other hand, FIG. 6B, and FIG. 7B are views illustrating one example of application states of radio-frequency voltages when a deflection electric field is formed. Also, FIG. 8B shows a voltage application state when the ion guide having 12 electrodes is operated as the pseudo quadrupole-type ion guide. As described above, the present invention is not limited to the case in which 2n is 8, and can be applied to an ion guide having any 2n electrodes.

Furthermore, it should be noted that any of the above embodiments and various modifications is merely an example, and any change, modification or addition appropriately made within the spirit of the present invention will evidently fall within the scope of claims of the present patent application.

REFERENCE SIGNS LIST

1 . . . Ionization Chamber
2 . . . First Intermediate Vacuum Chamber
3 . . . Second Intermediate Vacuum Chamber
4 . . . Third Intermediate Vacuum Chamber
5 . . . Analysis Chamber
6 . . . Ionization Probe
7 . . . Nozzle
8 . . . Desolventizing Tube
10 . . . First Ion Guide
11 . . . Skimmer
12 . . . Second Ion Guide
13 . . . Ion Lens
14 . . . Third Ion Guide
15 . . . Front-Stage Quadrupole Mass Filter
16 . . . Collision Cell
17 . . . Fourth Ion Guide
18 . . . Rear-Stage Quadrupole Mass Filter
19 . . . Ion Detector
20 . . . Controller
21 to 28 . . . Power Supply Section
31 to 38, 41 to 46, 51 to 5A, 61 to 6C . . . Rod Electrode
40, 50, 60 . . . Ion Guide
100 . . . Ion Guide Unit
110 . . . Ion Guide
111 . . . First Electrode
112 . . . Second Electrode
121 . . . Insulating Spacer
122 . . . Conducting Spacer
130 . . . Disk Spring
131 . . . Frame Portion
132 . . . Spring Portion
140 . . . Case
141 . . . Tubular Section
142 . . . First Support Section
143 . . . Second Support Section
144 . . . Disk Spring Fixing Section
150 . . . Thin Plate

151 . . . Frame Portion
152 . . . Metal Contact
C . . . Ion Optical Axis

The invention claimed is:

1. A mass spectrometer comprising an ion guide in which 2n (where n is an integer equal to or larger than 3) rod-like or plate-like electrodes extending along an ion optical axis are arranged so as to surround the ion optical axis, the mass spectrometer further comprising:

a) voltage generating means for generating a first radio-frequency voltage and a second radio-frequency voltage having a same amplitude as and an inverted phase from the first radio-frequency voltage, as voltages for forming a radio-frequency electric field in a space surrounded by the respective electrodes of the ion guide; and b) electrical connecting means for electrically connecting the voltage generating means and the respective electrodes of the ion guide such that the first radio-frequency voltage is applied to m (where m is an integer equal to or larger than 2 and equal to or less than 2n−1) electrodes adjacent to each other around the ion optical axis among the 2n electrodes constituting the ion guide, and the second radio-frequency voltage is applied to at least one of the other 2n−m electrodes;

the arrangement of the respective electrodes being rotationally symmetrical about the ion optical axis.

2. The mass spectrometer according to claim 1, wherein the number of electrodes constituting the ion guide is n=p×q (where p is an integer equal to or larger than 2, and q is an integer equal to or larger than 4), and the electrical connecting means is adapted to electrically connect the voltage generating means and the respective electrodes of the ion guide such that, among q electrode groups, where an electrode group consists of any p electrodes adjacent to each other around the ion optical axis, the first radio-frequency voltage is applied to p×q/2 electrodes belonging to q/2 electrode groups positioned alternately around the ion optical axis, and the second radio-frequency voltage is applied to the other p×q/2 electrodes belonging to other q/2 electrode groups.

3. The mass spectrometer according to claim 2, wherein n is 8, p is 2, q is 4, and a radio-frequency electric field mainly having a quadrupole field component is formed in the space surrounded by the eight electrodes constituting the ion guide.

4. The mass spectrometer according to claim 1, wherein the electrical connecting means is adapted to electrically connect the voltage generating means and the respective electrodes of the ion guide such that arrangement of the electrodes to which the first radio-frequency voltage is applied, and the electrodes to which the second radio-frequency voltage is applied around the ion optical axis is rotationally asymmetrical.

5. A method of driving an ion guide where, in an ion guide in which 2n (n is an integer equal to or larger than 3) rod-like or plate-like electrodes extending along an ion optical axis are arranged so as to surround the ion optical axis, predetermined voltages are applied to the respective electrodes to form an electric field for controlling a behavior of ions in a space surrounded by the electrodes, the method comprising:

applying a first radio-frequency voltage to m (m is an integer equal to or larger than 2 and equal to or less than 2n−1) electrodes adjacent to each other around the ion optical axis among the 2n electrodes constituting the ion guide, and applying a second radio-frequency voltage having a same amplitude as and an inverted phase from the first radio-frequency voltage to at least one of the other 2n−m electrodes;

the arrangement of the respective electrodes being rotationally symmetrical about the ion optical axis.

6. The method of driving an ion guide according to claim 5, wherein, with respect to the ion guide in which the number of electrodes is n=p×q (where p is an integer equal to or larger than 2, and q is an integer equal to or larger than 4), among q electrode groups, where an electrode group consists of any p electrodes adjacent to each other around the ion optical axis, the first radio-frequency voltage is applied to p×q/2 electrodes belonging to q/2 electrode groups positioned alternately around the ion optical axis, and the second radio-frequency voltage is applied to the other p×q/2 electrodes belonging to other q/2 electrode groups.

7. The method of driving an ion guide according to claim 5, wherein the first or second radio-frequency voltage is applied to the respective electrodes of the ion guide such that arrangement of the electrodes to which the first radio-frequency voltage is applied, and the electrodes to which the second radio-frequency voltage is applied around the ion optical axis is rotationally asymmetrical.

* * * * *